US005209573A

United States Patent [19]

Freeman

[11] Patent Number: 5,209,573

[45] Date of Patent: May 11, 1993

[54] TRASH CAN LINER

[75] Inventor: Scott T. Freeman, Fairport, N.Y.

[73] Assignee: Mobil Oil Corporation, Fairfax, Va.

[21] Appl. No.: 716,161

[22] Filed: Jun. 17, 1991

[51] Int. Cl.[5] ..... B65D 30/02; B65D 30/08; B65D 30/10

[52] U.S. Cl. ..... 383/109; 383/108; 383/114; 383/120

[58] Field of Search ..... 383/109, 114, 120, 107, 383/108, 121

[56] References Cited

U.S. PATENT DOCUMENTS

| | | | |
|---|---|---|---|
| 2,749,020 | 6/1956 | Baxter | 383/107 X |
| 2,819,834 | 1/1958 | Brady | 383/120 |
| 3,124,297 | 3/1964 | Vergobbi . | |
| 3,240,327 | 3/1966 | Brina . | |
| 3,349,991 | 10/1967 | Kessler | 383/120 |
| 3,478,952 | 11/1969 | Perlman | 383/107 X |
| 3,670,953 | 6/1972 | Leventhal | 383/120 X |
| 3,670,954 | 6/1972 | Leventhal | 383/120 X |
| 3,758,024 | 9/1973 | Bethke et al. | 383/120 X |
| 3,939,972 | 2/1976 | Mayworm | 383/107 X |
| 4,356,221 | 10/1982 | Anthony et al. | 383/109 X |
| 4,533,578 | 8/1985 | Boyd et al. | 383/109 X |
| 4,554,192 | 11/1985 | Benoit . | |
| 4,913,561 | 4/1990 | Beer . | |

FOREIGN PATENT DOCUMENTS

| | | | |
|---|---|---|---|
| 945953 | 4/1974 | Canada | 383/120 |
| 2526961 | 5/1976 | Fed. Rep. of Germany | 383/120 |
| 1443713 | 5/1966 | France | 383/121 |
| 776382 | 6/1957 | United Kingdom | 383/120 |
| 1275399 | 5/1972 | United Kingdom | 383/120 |
| 1584746 | 2/1981 | United Kingdom | 383/120 |

*Primary Examiner*—Allan N. Shoap
*Assistant Examiner*—Jes F. Pascua
*Attorney, Agent, or Firm*—Alexander J. McKillop; Charles J. Speciale; Malcolm D. Keen

[57] ABSTRACT

A trash can liner is disclosed which evenly distributes the load across the sealed bottom portion thereof. The liner includes a body portion which is formed from a tube of coextruded, thermoplastic film. The tube includes edge portions which are folded inwardly towards the center line of the tube along first and second fold lines. The tube is also folded along its center line prior to sealing to form a construction including eight overlapping walls of approximately equal width. A pair of heat seals extend through each of the eight overlapping walls at one end of the tube, the heat seals being separated by an unsealed area.

3 Claims, 3 Drawing Sheets

TRASH CAN LINER

BACKGROUND OF THE INVENTION

1. Field of the invention

The field of the invention relates to bags or sacks which may be used as liners for trash cans and the like.

2. Brief description of the related art

Bag-type liners are frequently used within trash cans for protecting the cans and to facilitate removal of the contents therefrom. The materials from which a liner is made and the manner in which it is constructed depends upon the intended use thereof. Liners intended for grass clippings and garden debris need not be particularly leak-proof as the consequences of leakage are insignificant. Where such liners are used for industrial waste, prevention of leakage is very important, even where the waste is not particularly hazardous.

Various approaches have been taken for manufacturing and sealing liners in order to prevent leakage therefrom. An early form of such liners was made from an unfolded tube. The entire width of the bottom of the tube was sealed with either a single or a double seal bar. This construction is referred to as the "lay flat" construction. In order to seal more bags in production, a gusseted bag has been produced. The seal across a gusseted bag does not hold up well under wet load testing, however.

Folded end seal bags have been found to provide a strong seal as the forces exerted upon the bottom of the bag are relatively uniformly distributed. Such bags or liners are formed by first folding the two outside edges of a tube towards the middle, then folding one resulting edge over the other. The seal extending across such bags is through eight layers.

"Star seals" are formed by folding the right edge over the left edge of a tube, and then again folding the right edge over the left edge. This type of seal also provides for stress distribution.

The presence of wrinkles in thermoplastic films, and particularly high molecular weight films, can cause deterioration of the seals at the bottoms of liners formed from such films. Penetration of the end seals by such wrinkles can result in leakage. Reduction of the number of wrinkles is only a partial solution to this problem.

SUMMARY OF THE INVENTION

It is an object of the invention to provide a trash can liner which is substantially leakproof.

It is another object of the invention to provide a trash can liner having an end seal which resists degradation.

A still further object of the invention is to provide a trash can liner having superior strength and an attractive appearance.

In accordance with these and other objects of the invention, a trash can liner is provided which comprises a body portion formed from a tube of coextruded, thermoplastic film, the tube being folded along a plurality of longitudinal fold lines to form at least eight overlapping walls, a first heat seal sealing an end of the tube and formed through all of the overlapping walls of the tube, and a second heat seal formed through all of the overlapping walls of the tube and extending parallel and adjacent to the first end seal. The inside and outside layers of the coextruded film are preferably different in color. Both layers are preferably high density polyethylene. The tube is preferably constructed in folded end seal form by folding the two edges of the tube towards the middle and then folding the entire tube along its center line. The end seals are then formed through eight walls of material.

DETAILED DESCRIPTION OF THE INVENTION

Figure 1:
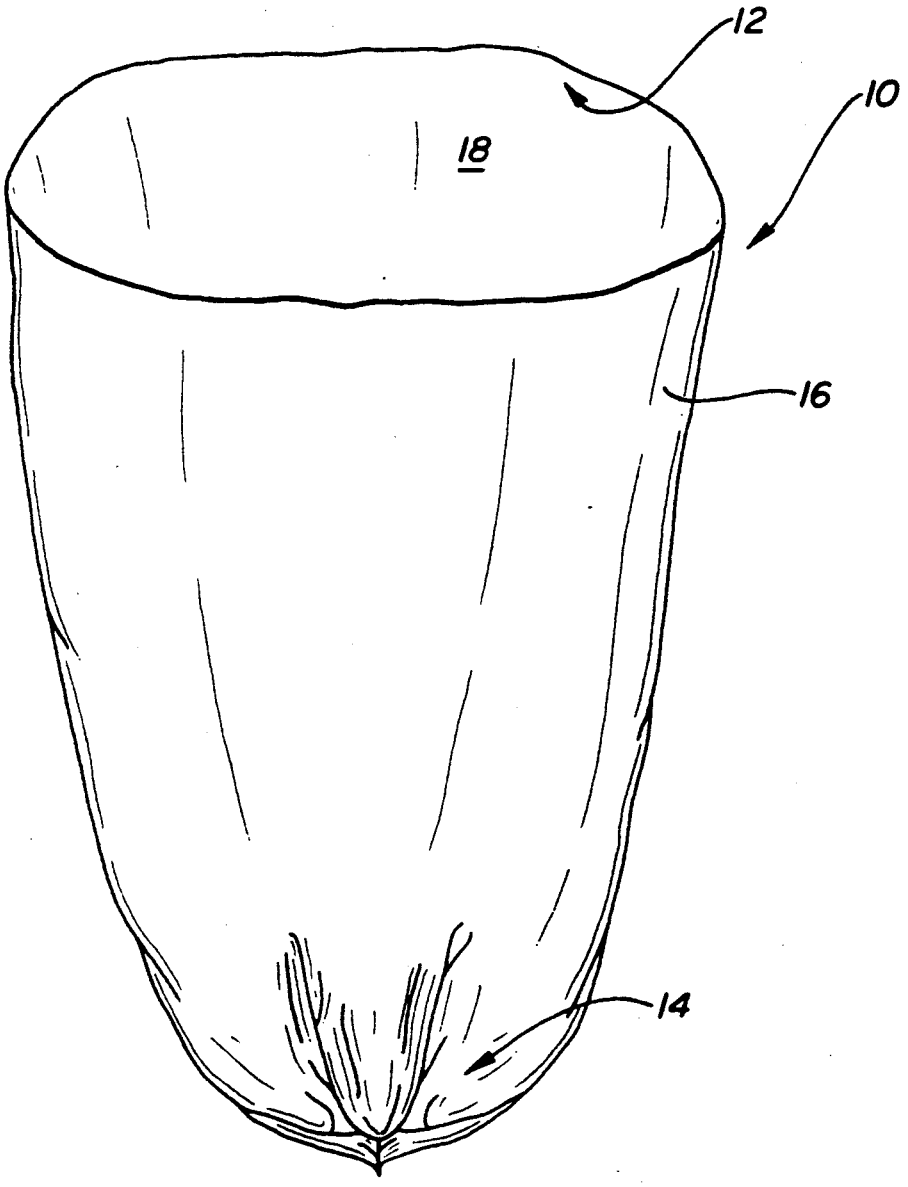
FIG. 1 is a top perspective view of a trash can liner in accordance with the invention.

A trash can liner 10 made from a tube of coextruded film is shown in FIG. 1. The liner includes an open top end 12 and a sealed bottom end 14. As the film is coextruded, the outer surface layer 16 may be made from a different material than the inner surface layer 18. The two layers are preferably of different colors whether made from the same or different materials. In a preferred embodiment of the invention, each of the layers is manufactured from a virgin high molecular weight resin such as high density polyethylene (HDPE). Each layer is preferably opaque.

Figure 2:
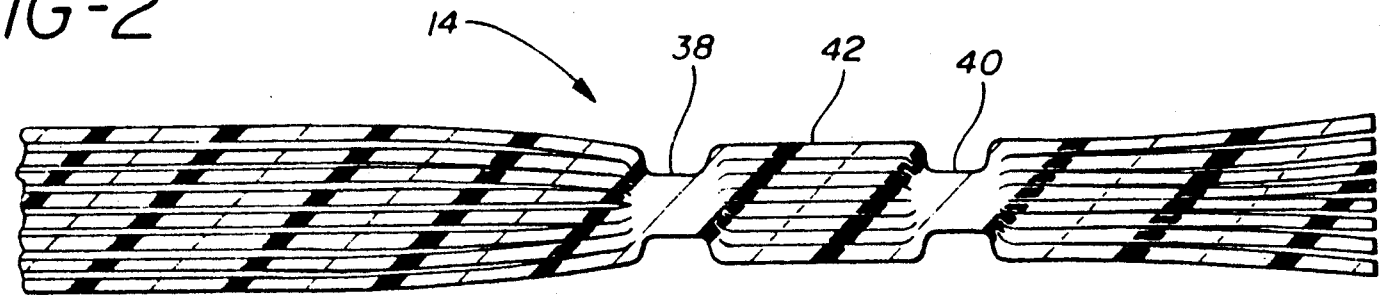
FIG. 2 is an enlarged sectional view of the closed, bottom end of the liner.
Figure 3:
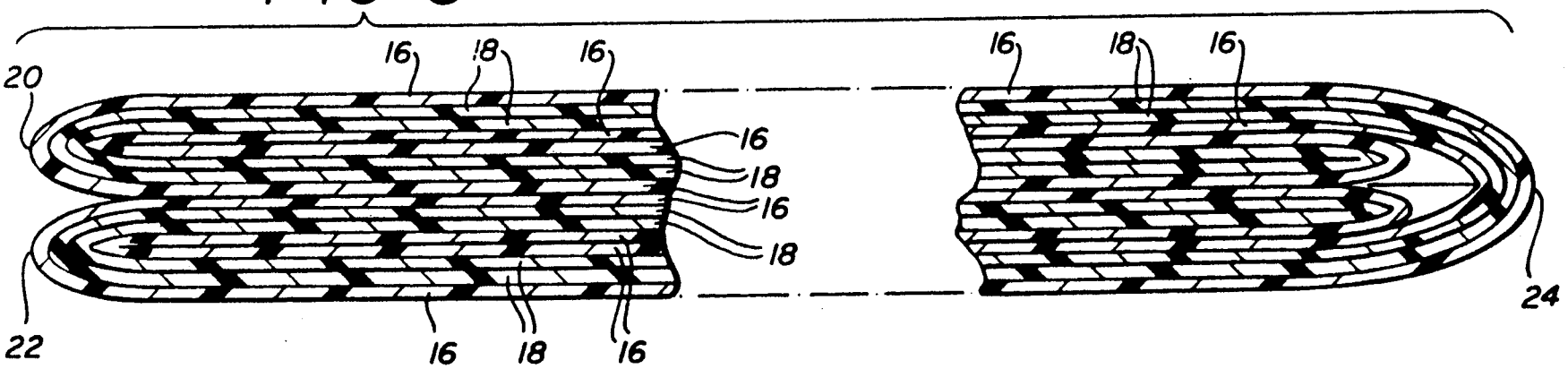
FIG. 3 is a greatly enlarged, sectional view taken laterally across the liner.

The tube from which the liner is made is folded in the manner shown in FIG. 3 prior to sealing the bottom end thereof. First and second folds 20,22 are made as the opposing edges of the tube are folded inwardly. The tube is then folded along its center line 24. A total of eight coextruded walls are accordingly arranged in stacked relation, as shown in FIGS. 2 and 3. Each of the walls is substantially equal in widths as shown in FIG. 3. The wall thickness is up to about one mil.

Figure 5:
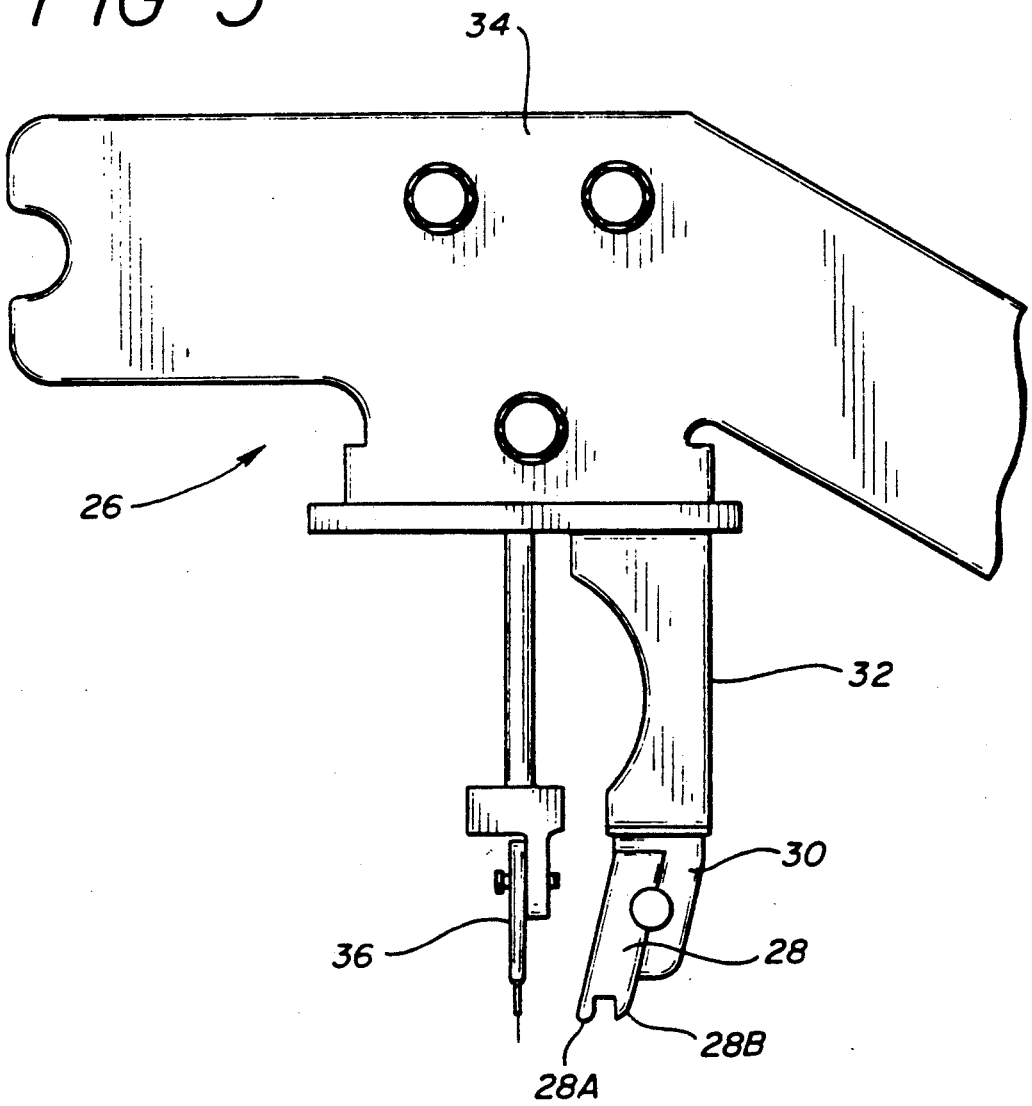
FIG. 5 is an elevation view of an apparatus for sealing the liner in accordance with the invention.

The tube, as folded in the manner shown in FIG. 3, is passed through a sealing station 26 as shown in FIG. 5. The station 26 includes a seal blade 28 including first and second sealing edges 28A, 28B. Each edge has a width of about one sixteenth of an inch. The leading and trailing edges are separated by a gap of about one eighth of an inch. The blade is preferably covered with TEFLON.

The seal blade is mounted to a heating element 30 which heats it to about 600°–650° F. when used for sealing eight adjoining walls of high density polyethylene. The heating element is secured to a bridge 32 which is, in turn, secured to the control head 34. The seal blade 28 is positioned directly about a platen (not shown) which, in use, is heated to a temperature of about 340° F.

A perforating blade assembly 36 is secured to the control head 34 and is positioned downstream in the machine direction from the seal blade 28. The perforating blade is used to form a line of perforation adjacent to each heat sealed area, and allows individual bags to be separated from a strip of such bags.

Figure 4:
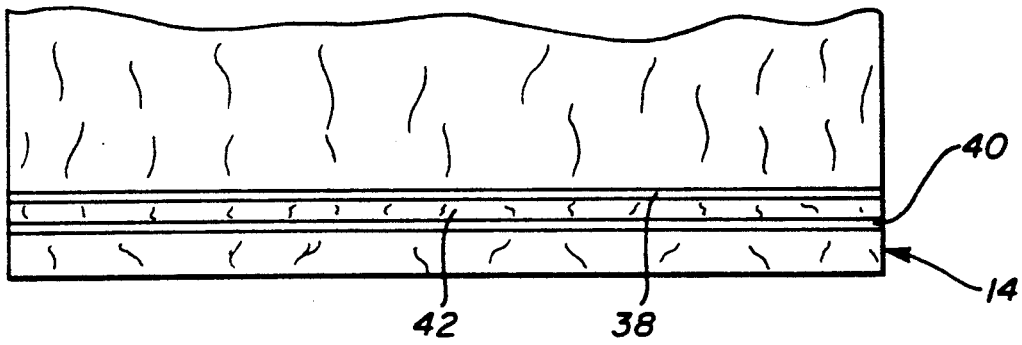
FIG. 4 is a top plan view of the sealed bottom end of a folded liner.

The product resulting from the sealing operation is shown in part in FIGS. 2 and 4, and in its entirety in FIG. 1. FIGS. 2 and 4 both show the bottom end of the bag as folded prior to expansion thereof for actual use. Referring to these figures, a pair of substantially parallel heat seals 38, 40 are formed through the eight adjoining walls of the bag. Each seal is about one sixteenth of an inch in width. The seals are separated by an unsealed area 42 which is about one eighth of an inch in width. The lower of the two heat seals 40 is about one quarter inch from the lower edge of the tube.

In use, the trash bags 10 may be stored in roll form. A bag can be separated from the roll along the line of perforations formed by the perforating blade assembly 36. Once separated, it may be unfolded from the compact forms shown in FIGS. 2–4 to the expanded form shown in FIG. 1. When expanded, the sealed end of the bag 10 is effective in distributing forces in many directions, thereby increasing the effectiveness of the bag under wet load testing. The bag can be secured to a trash can in a conventional manner.

There are a number of alternative methods for folding the tube from which the bag is made prior to sealing other than the preferred method discussed above. The "star" configuration discussed above is one possible alternative. Additional folds can be made to produce more than eight overlapping walls. While such constructions may provide for even superior stress distribution, the volume of the bag would be decreased.

The present invention has been found to significantly improve ultimate seal strength, toughness and elongation at break. Wet load values increased and end seal failures decreased when comparing double-sealed bags to those including a single seal. Degradation of the seals over time was also reduced.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A trash can liner comprising:

a body portion formed from a tube of coextruded, thermoplastic film, the film including an outer layer and an inner layer, the outer layer being a different opaque color than the inner layer, both the outer and inner layers being comprised of high density polyethylene, the tube being folded along a plurality of longitudinal fold lines to form at least eight overlapping walls;

said body portion including a closed end, said closed end including a first continuous heat seal extending transversely across the tube and formed through all of the overlapping walls of the tube and a second continuous heat seal extending transversely across the tube and formed through all of the overlapping walls of the tube, said first heat seal extending substantially parallel to and adjacent to said second heat seal, and an unsealed area defined between said first and second heat seals;

said body portion including an open end opposite from said closed end.

2. A trash can liner as described in claim 1 wherein said tube includes first and second edge portions and a longitudinal center line, said edge portions being folded inwardly towards said longitudinal center line along first and second fold lines, and said tube being folded along said center line, whereby said tube includes eight overlapping walls through which said first and second heat seals are formed, each of said overlapping walls being substantially equal in width.

3. A trash can liner as described in claim 1 wherein said first and second heat seals are separated by about one eighth of an inch, the second heat seal being about one quarter inch from an edge of the tube.

* * * * *